US011466489B2

(12) United States Patent
Mäihäniemi

(10) Patent No.: US 11,466,489 B2
(45) Date of Patent: Oct. 11, 2022

(54) LOCKING DEVICE TO PREVENT OPENING OF A DOOR/DOORS

(71) Applicant: Janne Mäihäniemi, Kyröskoski (FI)

(72) Inventor: Janne Mäihäniemi, Kyröskoski (FI)

( * ) Notice: Subject to any disclaimer, the term of this patent is extended or adjusted under 35 U.S.C. 154(b) by 20 days.

(21) Appl. No.: 16/970,562

(22) PCT Filed: Feb. 26, 2019

(86) PCT No.: PCT/FI2019/050154
§ 371 (c)(1),
(2) Date: Aug. 17, 2020

(87) PCT Pub. No.: WO2019/166696
PCT Pub. Date: Sep. 6, 2019

(65) Prior Publication Data

US 2021/0115712 A1 Apr. 22, 2021

(30) Foreign Application Priority Data

Mar. 1, 2018 (FI) ..... 20185190

(51) Int. Cl.
*E05C 19/00* (2006.01)
*E05B 17/20* (2006.01)
(Continued)

(52) U.S. Cl.
CPC ..... *E05C 19/004* (2013.01); *E05B 17/2092* (2013.01); *E05B 63/0004* (2013.01);
(Continued)

(58) Field of Classification Search
CPC ..... E05C 19/004; E05C 7/00; E05C 19/184; E05C 19/186; E05C 19/00; E05C 19/003;
(Continued)

(56) References Cited

U.S. PATENT DOCUMENTS 126,360 A 4/1872 Wheeler
2,151,587 A * 3/1939 Cassileth ..... E05C 19/18 292/288
(Continued)

FOREIGN PATENT DOCUMENTS

CN 102725465 A 10/2012
CN 206636425 U 11/2017
(Continued)

OTHER PUBLICATIONS

China Patent Office, Office Action, Application No. 201980016385.1, dated Feb. 3, 2021, 5 pages.
(Continued)

*Primary Examiner* — Kristina R Fulton
*Assistant Examiner* — Tal Saif
(74) *Attorney, Agent, or Firm* — Ziegler IP Law Group, LLC

(57) ABSTRACT

A locking device intended to prevent opening of a door/doors includes a body, which is capable of being coupled immovably to a door handle and prevents opening of a door/doors. The body is provided with a coupling arrangement adjustable with adjustment elements for locking the handle against an external surface of the door by being propped immovably on a vertical frame member of the door or on a handle of the adjacent door.

10 Claims, 7 Drawing Sheets

(51) Int. Cl.

| | |
|---|---|
| ***E05B 63/00*** | (2006.01) |
| ***E05B 65/00*** | (2006.01) |
| ***E05C 7/00*** | (2006.01) |
| ***E05C 19/18*** | (2006.01) |

(52) U.S. Cl.
CPC ..... *E05B 65/0003* (2013.01); *E05B 65/0082* (2013.01); *E05C 7/00* (2013.01); *E05C 19/184* (2013.01); *E05C 19/186* (2013.01)

(58) Field of Classification Search
CPC ..... E05C 19/007; E05C 19/18; E05C 19/188; E05C 7/04; E05B 17/2092; E05B 63/0004; E05B 65/0003; E05B 65/0082; E05B 65/0075; Y10T 292/20; Y10T 292/228; Y10T 292/23; Y10T 292/237; Y10T 292/34; Y10T 292/37; Y10T 292/373; Y10T 292/376; Y10T 292/379; Y10T 292/382; Y10T 292/385; Y10T 292/388; Y10T 292/391; Y10T 292/394; Y10T 292/397; Y10T 292/65; Y10T 292/67; Y10T 292/71; Y10T 292/73; Y10S 292/15; Y10S 292/19; Y10S 292/65
See application file for complete search history.

(56) References Cited

U.S. PATENT DOCUMENTS

| | | | | | |
|---|---|---|---|---|---|
| 2,514,738 | A * | 7/1950 | Bradley | E05C 19/186 | 292/288 |
| 3,383,130 | A * | 5/1968 | De Avila | E05B 65/1066 | 292/288 |
| 4,003,227 | A * | 1/1977 | Casey | E05B 13/002 | 70/14 |
| 4,082,334 | A * | 4/1978 | Volta | E05C 19/003 | 292/288 |
| 4,157,128 | A * | 6/1979 | Peters | E05D 11/1007 | 182/24 |
| 4,358,758 | A * | 11/1982 | Morton | E05C 19/004 | 340/545.7 |
| 4,560,192 | A | 12/1985 | Wilson et al. | | |
| D295,606 | S * | 5/1988 | Ault | D8/330 | |
| 5,294,160 | A * | 3/1994 | Arthur | E05C 19/18 | 292/288 |
| 5,340,172 | A | 8/1994 | Sweet | | |
| 5,908,213 | A | 6/1999 | Tippetts et al. | | |
| 6,018,968 | A * | 2/2000 | Sides | E05C 19/18 | 292/288 |
| 7,278,663 | B2 * | 10/2007 | Witchey | E05C 19/186 | 292/259 R |
| 7,637,130 | B2 | 12/2009 | Carr | | |
| 8,313,128 | B2 * | 11/2012 | Belyea | E05B 13/00 | 292/288 |
| 10,174,526 | B2 * | 1/2019 | Ramachandran | E05B 71/00 | |
| 2005/0023842 | A1 * | 2/2005 | Johnson | E05C 19/18 | 292/294 |
| 2006/0272365 | A1 * | 12/2006 | Copus | E05B 13/002 | 70/14 |
| 2009/0102205 | A1 | 4/2009 | Carr | | |
| 2012/0229251 | A1 * | 9/2012 | Ufkes | E05B 83/10 | 340/5.26 |
| 2012/0235427 | A1 * | 9/2012 | Miskel | E05C 19/186 | 292/288 |
| 2014/0103668 | A1 * | 4/2014 | McKinney | E05C 19/188 | 292/258 |

FOREIGN PATENT DOCUMENTS

| | | | | |
|---|---|---|---|---|
| CN | 206785116 | U | 12/2017 | |
| DE | 202010011951 | U1 | 12/2010 | |
| DE | 102010015396 | A1 | 10/2011 | |
| DE | 202017106782 | U1 | 2/2018 | |
| GB | 2336397 | A | 10/1999 | |
| GB | 2400402 | A | 10/2004 | |
| GB | 2507827 | A * | 5/2014 | E05B 13/001 |
| GB | 2507827 | A | 5/2014 | |
| GB | 2514787 | A | 12/2014 | |
| WO | 2014053139 | A1 | 4/2014 | |
| WO | 2014083298 | A1 | 6/2014 | |
| WO | WO-2016157034 | A1 * | 10/2016 | E05B 45/06 |

OTHER PUBLICATIONS

Finnish Patent Office, Application No. 20185190, Office Action, dated Sep. 24, 2018, 6 Pages.
Patent Cooperation Treaty, International Search Report, Application No. PCT/FI2019/050154, dated Jun. 16, 2019, 3 Pages.
European Patent Office, Extended European Search Report, Application No. 19760331.9, dated Nov. 10, 2021, 7 pages.

* cited by examiner

LOCKING DEVICE TO PREVENT OPENING OF A DOOR/DOORS

FIELD

The aspects of the disclosed embodiments relate to a locking device according to the preamble of an independent claim directed thereto.

BRIEF DESCRIPTION OF RELATED DEVELOPMENTS

In particular, doors provided with so-called pull handles or double doors are used also in indoor spaces without a separate locking arrangement for locking the door or double doors shut, which is nevertheless necessary in certain cases for preventing uncontrolled passage of e.g. pets, small children or memory-impaired persons. As for the locking of doors provided with pull handles, there are not available today easily installable and reliably working locking arrangements which would not require fixed installations to be made on the door or doors.

SUMMARY

The locking device according to the aspects of the disclosed embodiments is directed to provide a decisive improvement regarding the foregoing problem and to thereby raise substantially the present state of the art. In order to attain this objective, the locking device of the disclosed embodiments is principally characterized by what is presented in the characterizing clause of an independent claim directed thereto.

As most significant benefits gained by a locking device of the disclosed embodiments should be mentioned the simplicity of its construction and operation, whereby disallowing the opening of a door, especially one with a pull handle, is achievable with a very simple and easily mountable construction. As the aspects of the disclosed embodiments are based on mechanically locking a door handle against an external surface of the door by being propped immovably on an upright frame member of the door or on a handle of the adjacent door, it is not necessary to provide either the door or its frame member with any installations but, instead, the device is in any event readily and quickly mountable in its place.

In a preferred embodiment, the locking device's body includes body members, which are movable relative to each other, bearing against a rear surface of the door handle and an external surface of the door, and which are provided with clamping elements for coupling the body immovably to the door handle by distancing the body members with respect to each other. In a preferred embodiment of the present disclosure, there is further utilized a locking rod, which is propped on a horizontal support surface such as a floor, on a door frame structure or in the like manner, and which, in addition, is further coupled to the body in a removable manner. Thus, the locking device is easily storable in parts. In this context, it is further possible to minimize the space demand of a locking rod by constructing the same on a so-called fishing rod principle of several short sections.

Other preferred embodiments for a locking device of the present disclosure are presented in the dependent claims directed thereto.

DESCRIPTION OF THE DRAWINGS

A detailed description of the disclosed embodiments will be presented in the subsequent specification with reference to the accompanying drawings, in which.

BRIEF DESCRIPTION OF RELATED DEVELOPMENTS

The disclosed embodiments relate to a locking device intended to prevent opening of a door/doors, said locking device comprising a body 2, which is capable of being coupled immovably to a door handle 1 and prevents opening of a door/doors o1, o2. The body 2 is provided with a coupling arrangement 20 adjustable with adjustment elements 2*a* for locking the handle 1 against an external surface U of the door o1 by being propped, as shown e.g. in FIGS. 1 and 5, immovably on a vertical frame member y of the door or, as shown e.g. in FIGS. 2-4, on a handle of the adjacent door o2.

In a preferred embodiment for a locking device of the present disclosure, its coupling arrangement 20 comprises body members 2', 2", which are included in the body, movable relative to each other, and resting against a rear surface 11 of the door handle 1 and the external surface U of the door. In this context, the adjustment elements 2*a* comprise preferably a screw arrangement 2*a*' for engaging the body to be pressed between the rear surface 11 of the door handle 1 and the external surface U of the door by distancing the body members 2', 2" with respect to each other.

Figure 1:
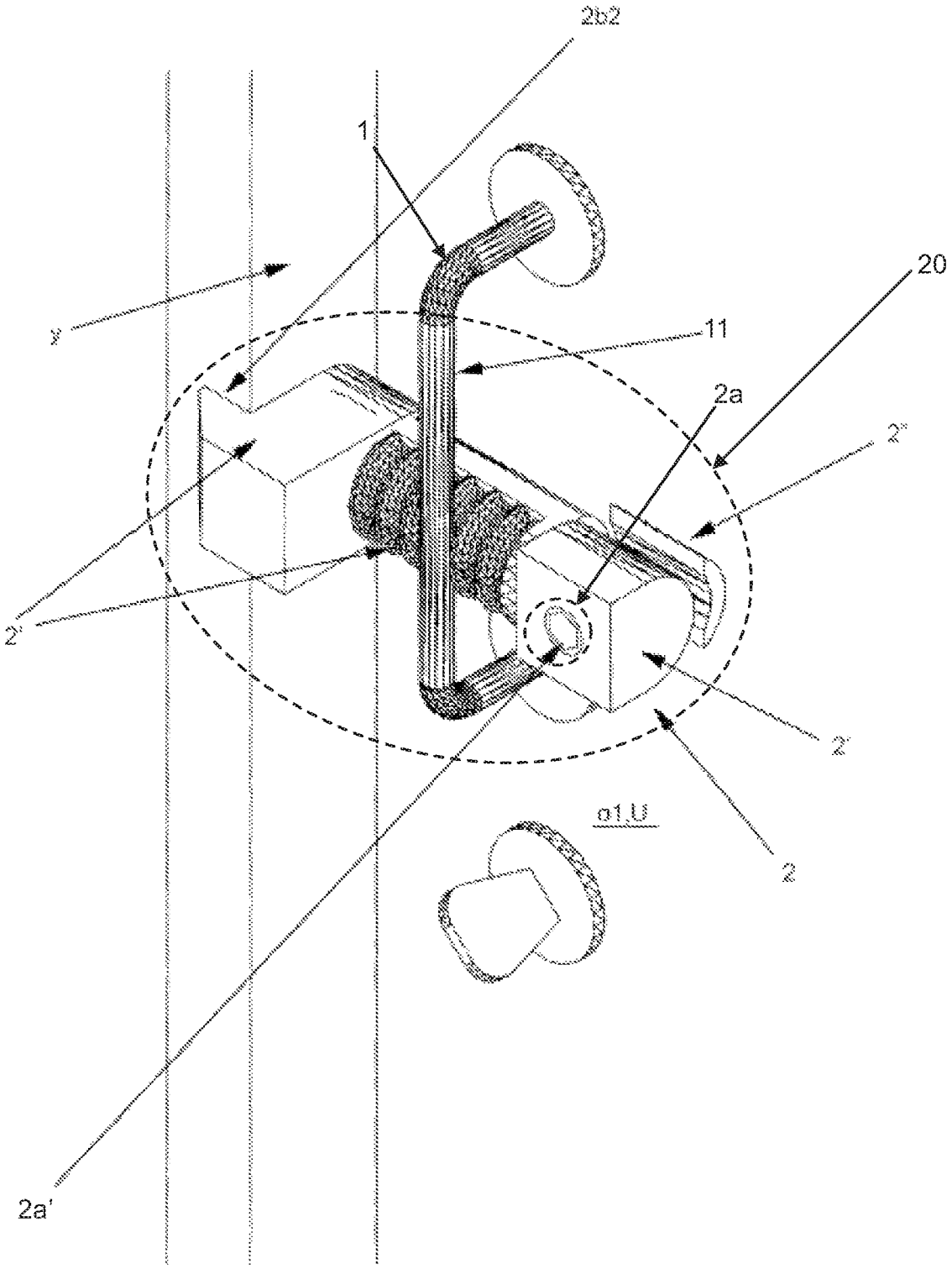
FIG. 1 shows one preferred locking device of the disclosed embodiments in a perspective view in connection with a door handle of the so-called pull handle type.

In a preferred embodiment of the present disclosure, referring specifically to the embodiment shown in FIG. 1, the coupling arrangement 20 comprises a form locking surface 2*b*2 included in the body 2 and resting against the vertical frame member y of the door 1.

Especially the body 2 of a locking device shown in FIG. 1 includes an intermediate member 2' presented with sparse threading, which presses against a rear surface 11 of the door handle 1 as one end of the body is pressed against the external door surface U via a movable body member 2" by using the screw arrangement 2*a*'. Consequently, the form locking surface 2*b*2, included in the body member 2' present at an opposite end of the body, is also pressed against the door frame member y.

Figure 2:
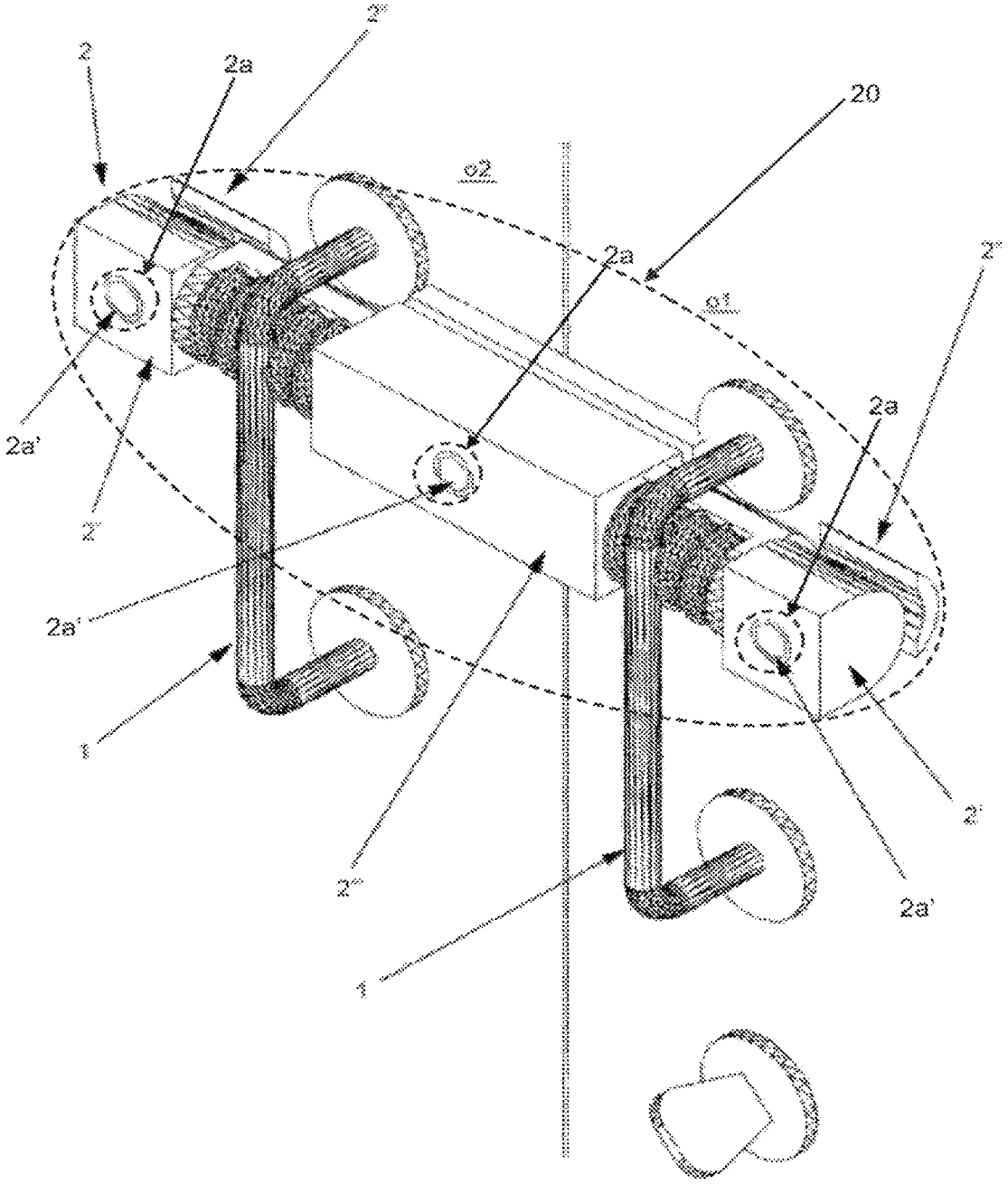
FIG. 2 shows, in a perspective view, one preferred locking device of the disclosed embodiments in connection with the pull handles of double doors.

The locking device of FIG. 2, present in association with double door handles 1, corresponds in its operating principle to the foregoing with the exception, however, that the body includes an auxiliary body 2''' present between the handles 1 and likewise provided with a body member 2" movable with adjustment elements 2*a*. Hence, the locking of double doors can be remarkably enhanced by the pressure applied to a gap between the doors.

Figure 5:
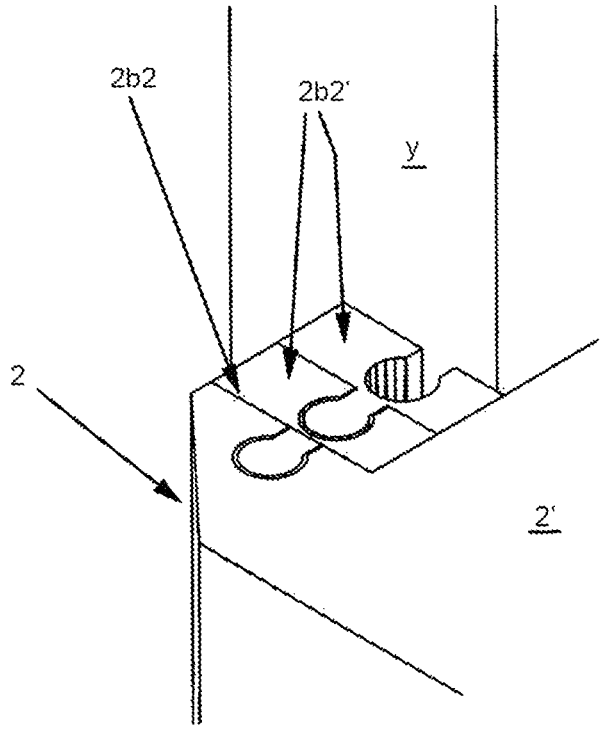
FIG. 5 shows, in a perspective view, an enlarged detail of one preferred aspect in a locking device of the disclosed embodiments in connection with the pull handles of double doors.

In a further preferred embodiment of the present disclosure, the form locking surface 2*b*2 is adapted, in a manner appearing from FIG. 5, to be adjustable with adjustment pieces 2*b*2' connectable to the body 2, in which context the adjustment pieces 2*b*2' are adapted for attachment to the body's form locking surface 2*b*2 most preferably on a so-called quick release coupling principle or e.g. form locking. It is also possible to make use of the above-described adjustment principle similar manner e.g. in connection with a door frame structure which is multiband or curving in vertical direction.

Figure 3:
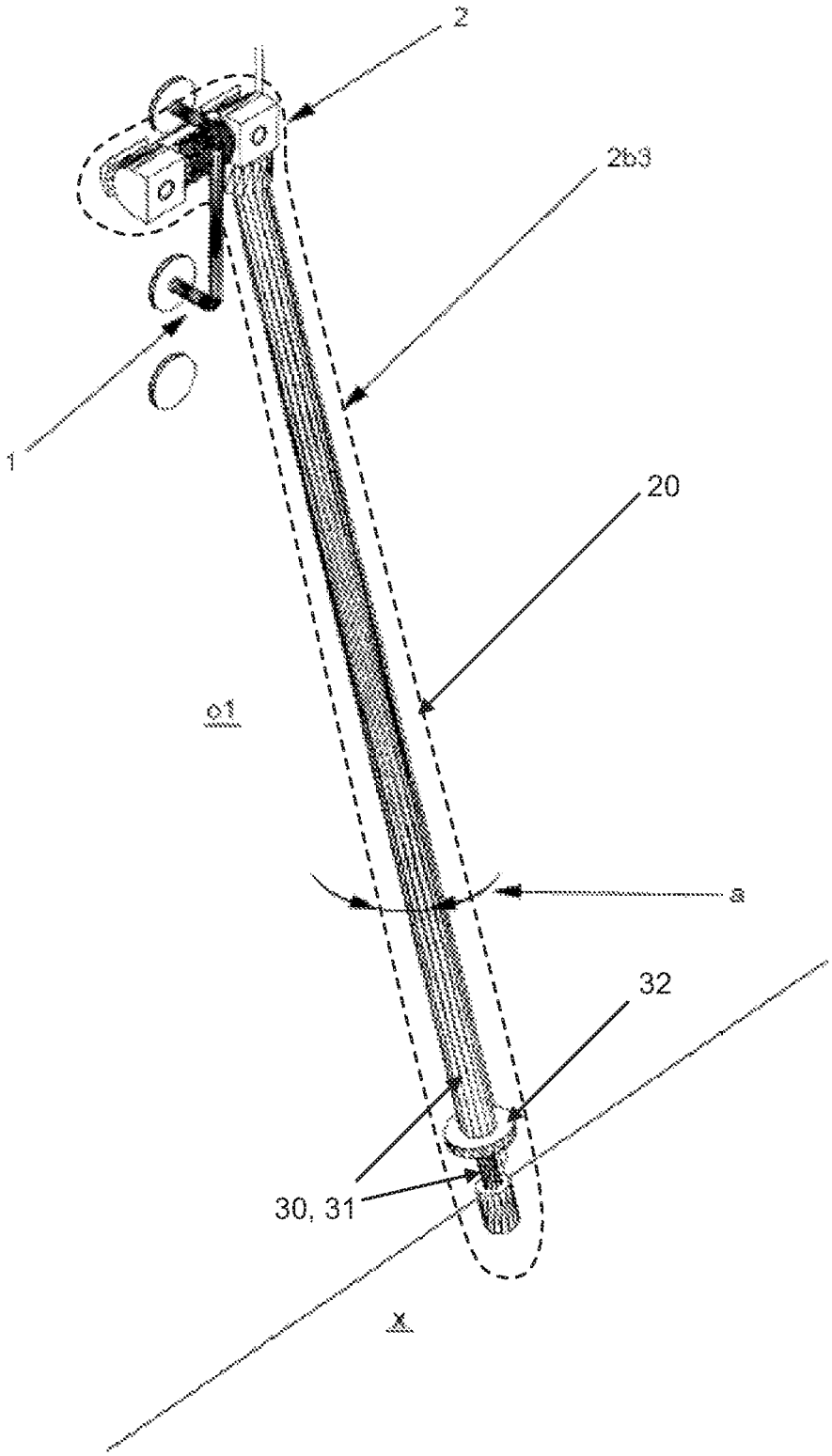
FIG. 3 shows, in a perspective view, one further embodiment for a locking device of the disclosed embodiments.
Figure 4:
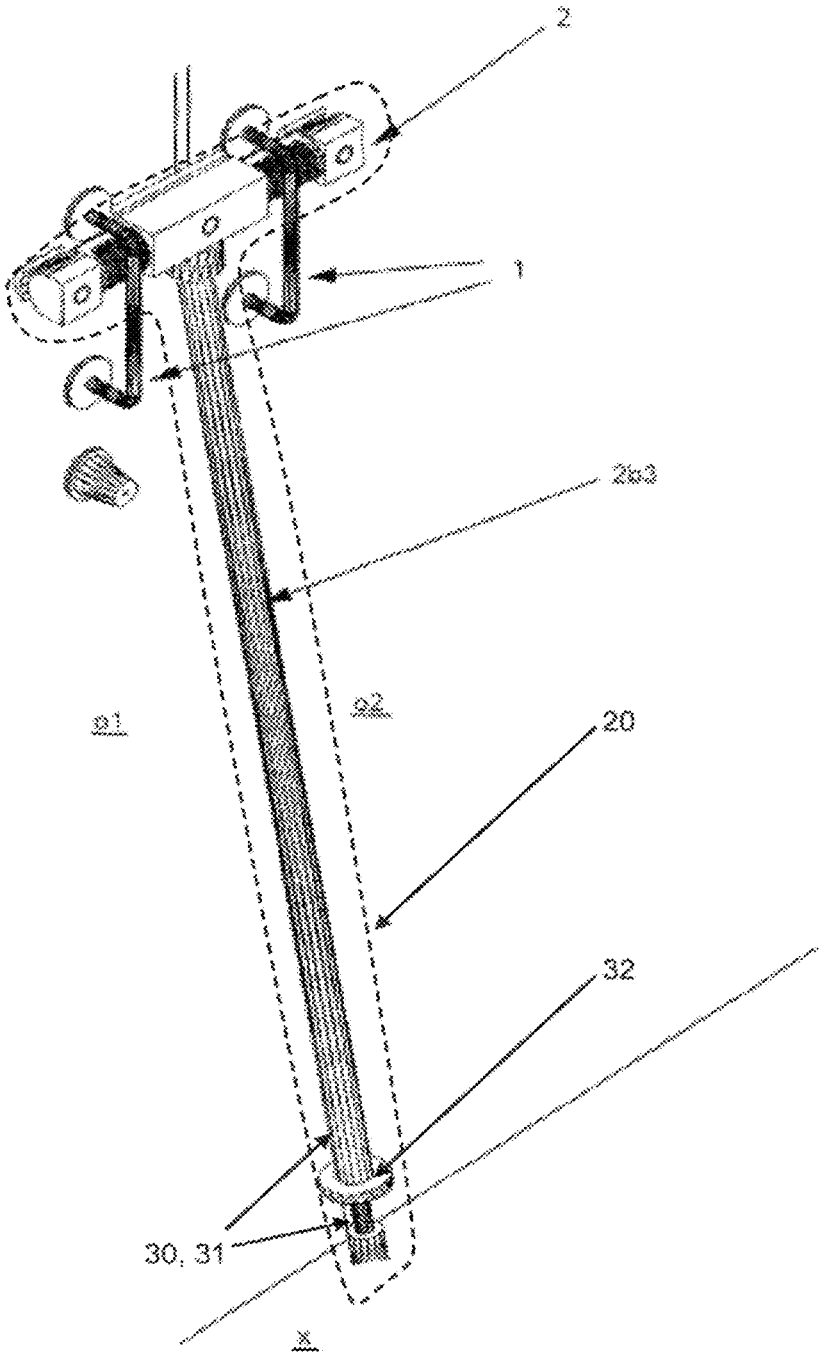
FIG. 4 shows, in a perspective view, the embodiment of FIG. 3 in connection with double doors.

In a further preferred embodiment of the present disclosure, with particular reference to FIGS. 3 and 4, the coupling arrangement 20 further comprises a locking rod 2*b*3, which is propped on a horizontal support surface x, such as a floor, a door threshold member or the like, and set in a position a inclined towards the door. The body 2 and the locking rod 2*b*3 are coupled to each other preferably in a removable manner e.g. with a bayonet, threaded, snap-fit joint and/or the like.

The locking rod 2*b*3 consists preferably of two or more rod sections 30, 31 displaceable on telescopic principle lengthwise relative to each other, whereby the length adjustment of the locking rod 2*b*3 and its locking to a desired length is provided by means of an adjustment arrangement 32 between its rod sections 30, 31, such as by means of a conical surface, friction, screw joint and/or the like. In this regard, it is possible to utilize preferably stepless twist locking adjustment generally employed e.g. in Nordic walking poles or in the extension handles of cleaning products.

Figure 6:
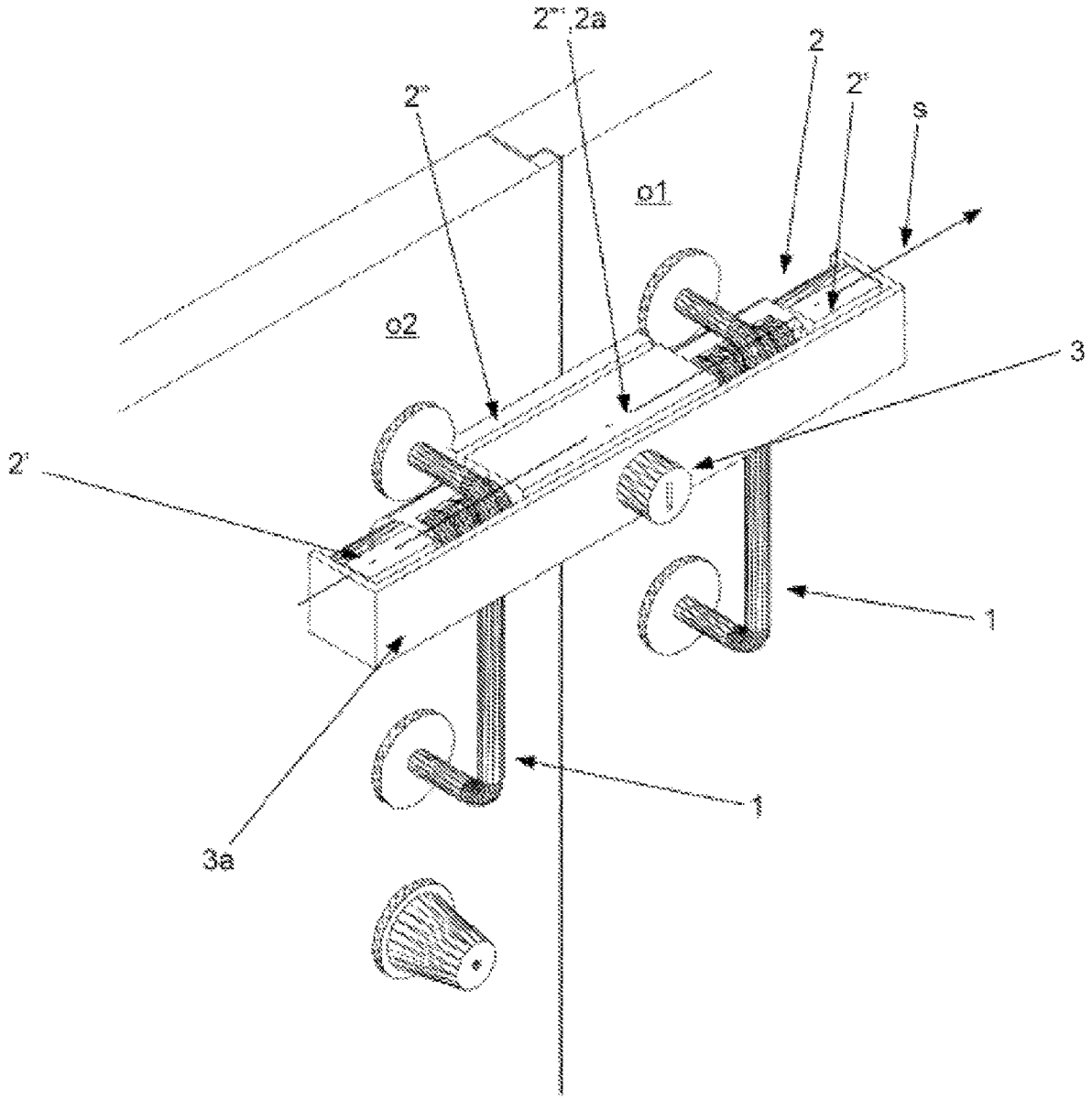
FIG. 6 shows, in a perspective view, one further optional locking device of the disclosed embodiments in connection with the pull handles of double doors.
Figure 7:
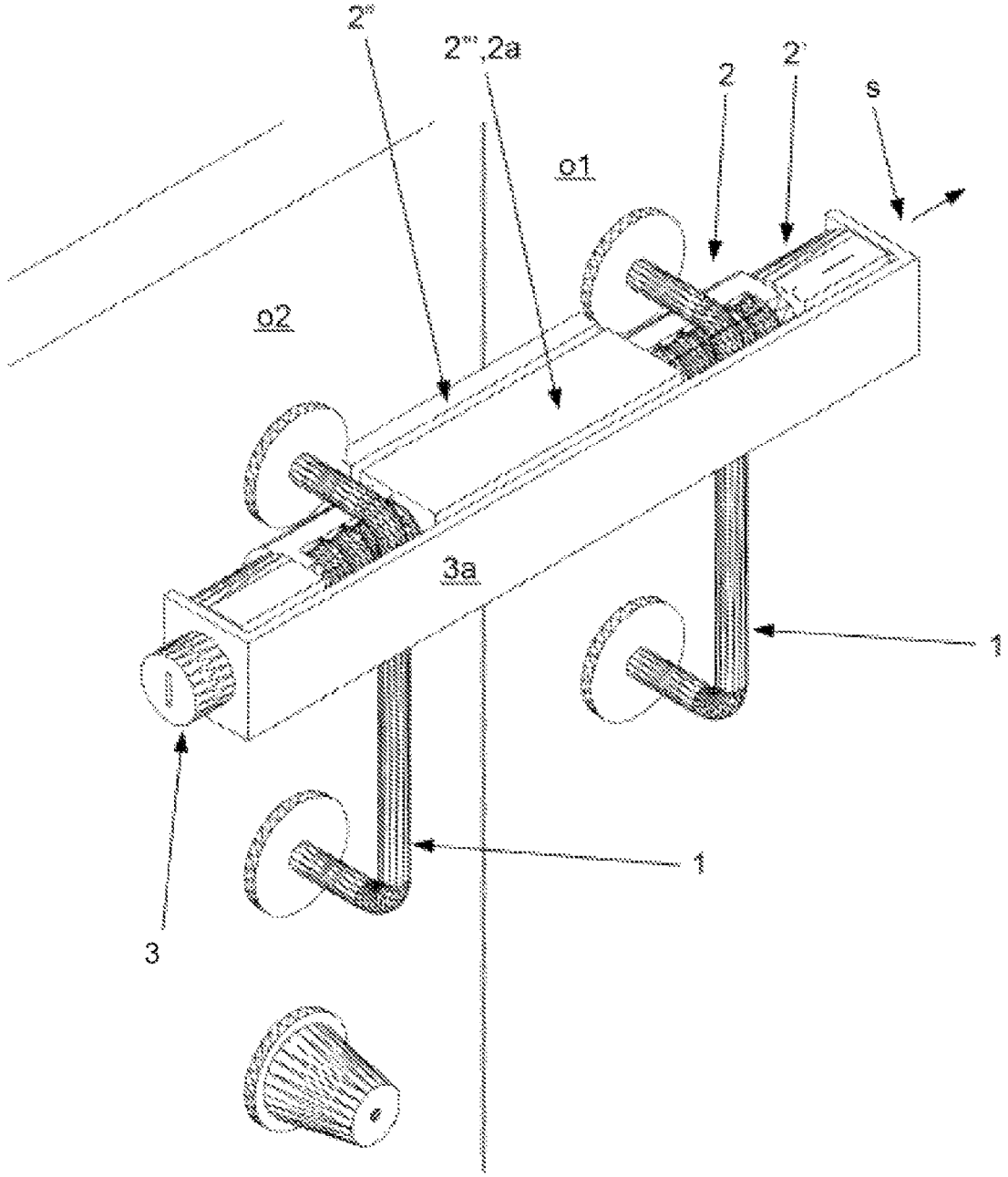
FIG. 7 shows, in a perspective view, one further locking device which is optional with respect to the locking device presented in FIG. 6.

In further preferred embodiments, with particular reference to alternative locking devices depicted in FIGS. 6 and 7, there is provided a locking arrangement 3 for locking the body 2, which is used for locking two side-by-side door handles 1, a manner to make it non-rotatable relative to its longitudinal axis s, which is implemented with a plate assembly 3*a* bearing against back surfaces of the handles 1 and, by its orthogonally directed ends, against external surfaces of the doors o1, o2. In this context, it is possible to utilize as the locking assembly 3 a key-operated mechanical locking mechanism or optionally e.g. its wirelessly operated electrical counterpart.

In a further preferred embodiment, with reference to FIGS. 6 and 7, the locking device further includes a monitoring and/or alarm system implemented preferably on a remote operating principle, such as e.g. on a cloud server principle, for tracking the locking device.

It is clear that the aspects of the disclosed embodiments are not limited to the foregoing embodiments but can be varied within the basic inventive concept in a multitude of ways in connection with various types of doors and door structures. Hence, it is first of all obvious that the locking device according to the disclosed embodiments can be manufactured from most diverse materials, such as wood, plastic, metal, carbon fiber, a composite material or any material suitable for the purpose.

The locking device is further capable of being provided with alarm unit based on e.g. force and/or acceleration sensors, which alerts e.g. with a sound and/or light signal about having a force or movement applied thereto. The disclosed embodiments can be applied not only to prevent opening of a door or doors but naturally also for tracking that any type of pull handle-equipped door, window, cabinet door or hatch remains securely closed.

The invention claimed is:

1. A locking device intended to prevent opening of a door and/or doors, said locking device comprising a body, which is capable of being coupled immovably to a handle on the door or handles on the doors and prevents opening of the door and/or doors, the body being provided with a coupling arrangement adjustable with adjustment elements for locking the handle or the handles against an external surface of the door by being propped immovably on a vertical frame member of the door or on a handle of the adjacent door, wherein said coupling arrangement comprises an intermediate member and a movable body member that are mutually movable with respect to each other, and wherein the adjustment elements comprise a screw arrangement configured to form a distance between the intermediate member and the movable body member so that the intermediate member is engaged with the rear surface of the handle or the handles and the movable body member is engaged the external surface of the door.

2. The locking device according to claim 1, wherein the coupling arrangement further comprises a form locking surface included in the body and resting against a vertical frame member of the door.

3. The locking device according to claim 2, wherein the form locking surface is adapted to be adjustable with adjustment pieces that are connectable to the body and adapted for attachment to the body's form locking surface.

4. The locking device according to claim 1, wherein the coupling arrangement further comprises a locking rod, which is propped on a horizontal support surface, and set in a position inclined towards the door and/or doors.

5. The locking device according to claim 4, wherein the body and the locking rod are coupled to each other in a removable manner.

6. The locking device according to claim 4, wherein the locking rod comprises two or more rod sections displaceable telescopically lengthwise relative to each other.

7. The locking device according to claim 4, wherein the length adjustment of the locking rod and its locking to a predetermined length is provided by means of an adjustment arrangement between its rod sections.

8. The locking device according to claim 1, wherein there is provided a locking arrangement for locking the body, which is used for locking two side-by-side door handles, in a manner to make it non-rotatable relative to its longitudinal axis.

9. The locking device according to claim 1, wherein the intermediate member comprises sparse threading that is engaged the rear surface of the handle.

10. The locking device according to claim 4, wherein the horizontal support surface comprises a floor or a door threshold member.

* * * * *